US008318993B2

(12) United States Patent
Wu et al.

(10) Patent No.: US 8,318,993 B2
(45) Date of Patent: Nov. 27, 2012

(54) LUBRICANT BLEND COMPOSITION

(75) Inventors: Margaret May-Som Wu, Skillman, NJ (US); Jon Edmond Randolph Stanat, Baton Rouge, LA (US); Kyle D. Lawrence, Houston, TX (US); Richard T. Spissell, National Park, NJ (US); James William Gleeson, Sewell, NJ (US); James Thomas Carey, Medford, NJ (US); Charles Lambert Baker, Thornton, PA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 2084 days.

(21) Appl. No.: 11/300,982

(22) Filed: Dec. 15, 2005

(65) Prior Publication Data

US 2006/0157383 A1 Jul. 20, 2006

Related U.S. Application Data

(63) Continuation-in-part of application No. 11/150,333, filed on Jun. 10, 2005, now abandoned, which is a continuation of application No. 10/367,245, filed on Feb. 14, 2003, now abandoned.

(60) Provisional application No. 60/362,584, filed on Mar. 5, 2002.

(51) Int. Cl.
*C10M 107/02* (2006.01)
*C10M 111/00* (2006.01)

(52) U.S. Cl. ..... 585/12; 585/13; 208/18; 208/19; 508/465; 508/579; 508/591

(58) Field of Classification Search ..... 508/591; 585/12, 13; 208/18, 19
See application file for complete search history.

(56) References Cited

U.S. PATENT DOCUMENTS

| | | | |
|---|---|---|---|
| 3,923,919 | A | 12/1975 | Stearns et al. |
| 4,540,753 | A | 9/1985 | Cozewith et al. |
| 4,776,967 | A | 10/1988 | Ichihashi et al. |
| 4,789,714 | A | 12/1988 | Cozewith et al. |
| 4,853,139 | A | 8/1989 | Ichihashi |
| 4,922,046 | A | 5/1990 | Kinoshita et al. |
| 4,956,122 | A | 9/1990 | Watts et al. |
| 4,966,722 | A | 10/1990 | Smith |
| 5,068,476 | A | 11/1991 | Wu et al. |
| 5,108,635 | A | 4/1992 | Gabillet et al. |
| 5,217,636 | A | 6/1993 | Paboucek |
| 5,498,809 | A | 3/1996 | Emert et al. |
| 5,705,577 | A | 1/1998 | Rossi et al. |
| 5,767,331 | A | 6/1998 | Oda et al. |
| 5,837,773 | A | 11/1998 | Olivier et al. |
| 5,859,159 | A | 1/1999 | Rossi et al. |
| 6,034,040 | A | 3/2000 | Ozbalik et al. |
| 6,060,437 | A | 5/2000 | Robson et al. |

(Continued)

FOREIGN PATENT DOCUMENTS

| | | |
|---|---|---|
| EP | 0 088 453 | 9/1983 |

(Continued)

*Primary Examiner* — Ellen McAvoy
(74) *Attorney, Agent, or Firm* — Joseph Allocca

(57) ABSTRACT

A fluid blend suitable for use as a lube basestock comprises two major components: (A) a copolymer made from ethylene with one or more alpha olefins, the copolymer (i) containing not more than 50 wt % ethylene; (ii) having a number average molecular weight of from 400 to 10,000; and (iii) a molecular weight distribution <3; and (B) a polyalphaolefin fluid or a hydroprocessed oil having a VI greater than 80.

17 Claims, 4 Drawing Sheets

U.S. PATENT DOCUMENTS

| | | | | |
|---|---|---|---|---|
| 6,110,880 | A | 8/2000 | Verstrate et al. | |
| 6,218,488 | B1 | 4/2001 | Schiffino et al. | |
| 6,303,548 | B2 | 10/2001 | Gao | |
| 6,362,286 | B1 | 3/2002 | Gardiner et al. | |
| 7,018,962 | B2 * | 3/2006 | Bloch et al. | 508/591 |
| 7,399,737 | B2 * | 7/2008 | Hazelton et al. | 508/591 |
| 2001/0007851 | A1 | 7/2001 | Gao | |

FOREIGN PATENT DOCUMENTS

| | | | |
|---|---|---|---|
| EP | 0 119 070 | | 9/1984 |
| EP | 0 119069 | | 9/1984 |
| EP | 0 276 320 | | 8/1988 |
| EP | 0 280 260 | | 8/1988 |
| EP | 0 291 006 | | 11/1988 |
| EP | 0 359 466 | B1 | 3/1990 |
| EP | 0 452 998 | A2 | 10/1991 |
| EP | 0 561 335 | A1 | 9/1993 |
| JP | 01168798 | A | 7/1989 |
| JP | 1993070788 | A | 3/1993 |
| JP | 1993117681 | A | 5/1993 |
| JP | 1994228530 | A | 8/1994 |
| JP | 2503536 | B2 | 6/1996 |
| WO | WO 98/21297 | | 5/1998 |

* cited by examiner

LUBRICANT BLEND COMPOSITION

This application is a continuation-in-part of U.S. Ser. No. 11/150,333 filed Jun. 10, 2005, now abandoned, which is a continuation of U.S. Ser. No. 10/367,245 filed Feb. 14, 2003, now abandoned, which claims the benefit of U.S. Provisional Application 60/362,584 filed Mar. 5, 2002.

FIELD OF INVENTION

The present invention relates to lubricant fluid blends especially suitable as base stocks for lubricant compositions. More particularly the inventive relates to lubricant fluid blends based on hydroprocessed oils and copolymers made from ethylene with one or more alpha-olefins.

BACKGROUND OF INVENTION

Most lubricant base stocks, including most of API Group I to Group IV fluids, have viscosities at 100° C. in the range of about 4 to about 6 cSt. When these base stocks are used to formulate different viscosity grade lubricants it is necessary to blend them with high viscosity base stocks. Currently, the readily available high viscosity base stocks include bright stock, high viscosity polyalphaolefin (PAOs) and polyisobutylene (PIB).

Bright stock and PIB have poor viscosity indices (VIs) and poor low temperature properties and hence their potential to improve blend properties is limited. This is especially true when blended with low viscosity hydro-processed Group II, Group III fluids or isomerate lubes derived from Fischer-Tropsch wax, which usually have VIs close to or greater than 100. Experience has shown that when Group II, Group III or Fischer-Tropsch wax isomerate fluids are blended with polyisobutylene (PIB) or bright stock, on many occasions, the resulting blends have even lower VIs than the starting Group II or Group III fluids.

High viscosity PAOs have excellent viscometrics and low temperature properties; however, they are more expensive than PIB or bright stock. Moreover, the availability of PAOs is limited to some extent due to the limited supply of the linear alpha olefins, such as 1-decene, used in preparing them.

There is a need, therefore, for fluid lubricant base stocks having good viscometrics, low temperature properties and shear stability that can be made from readily available material.

Accordingly, one object of the present invention is to provide a blend of lubricant fluids having improved viscometrics when compared to blends containing PIB, bright stock or PAOs.

Another object is to provide lubricant fluid blends having improved shear stability when compared to blends containing PIB, bright stock or PAOs.

Other objects and advantages will become apparent upon reading the specification which follows:

SUMMARY OF INVENTION

Simply stated, the present invention is directed toward a fluid blend suitable for use as a lube basestock comprising two major components: (A) a polymer made from ethylene with one or more alpha-olefins and containing not more than 50 wt % ethylene, the copolymer having a number average molecular weight from up 400 to 10,000 and having a molecular weight distribution (MWD)<3 and (B) a polyalpha olefin or hydroprocessed oil having a VI greater than 80.

In another embodiment a lubricating composition is provided comprising the fluid blend and a lubricant additive package.

DETAILED DESCRIPTION OF INVENTION

Figure 1:
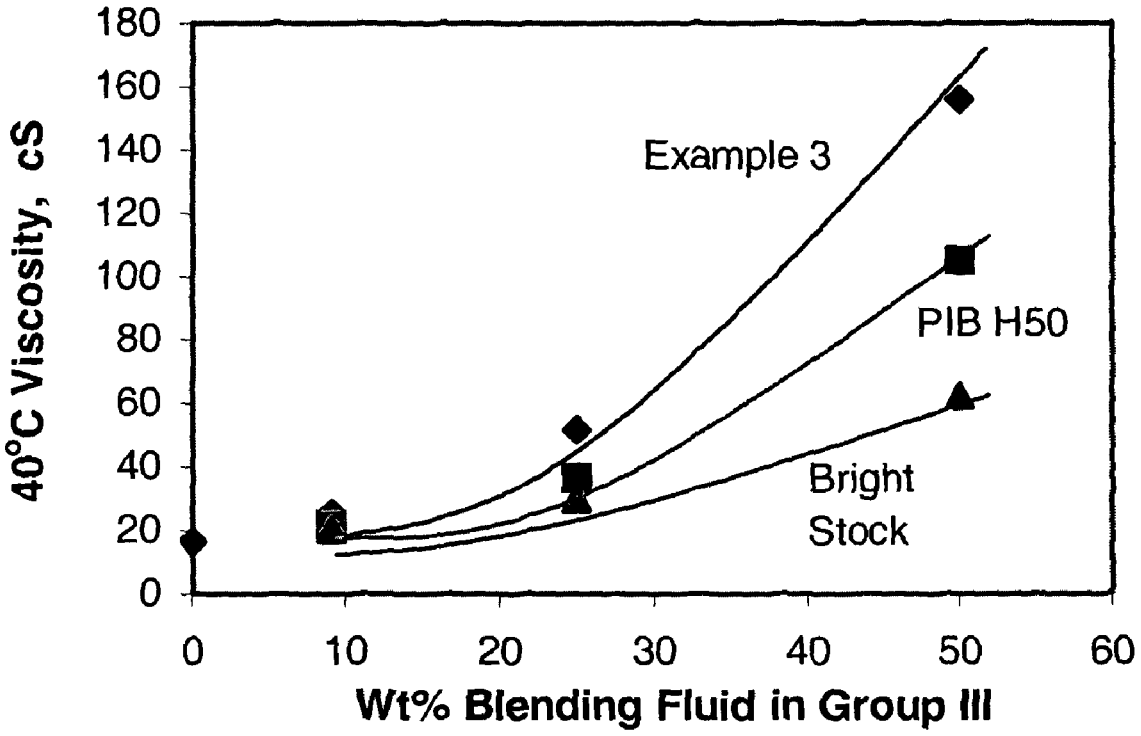
FIGS. 1 to 4 graphically compare the viscosity of lubricant base tock blends prepared from the copolymers of the invention with viscosities of lends employing polyisobutylene or bright stock.

One major component, component A, in the fluid blend of the present invention is a copolymer made from ethylene with one or more alpha-olefins. Consequently, as used herein, the term copolymer encompass polymers containing 2, 3 or more different monomer moieties. The copolymers in the blend of the invention have a number average molecular weight of from 400 to 10,000 and a MWD<3. Importantly, the copolymer contains not more than 50 wt % ethylene. The alpha-olefin moiety of the copolymer will be derived from at least one or more $C_3$, $C_4$ or higher alpha olefins.

Accordingly, suitable alpha-olefinic monomers include those represented by the formula $H_2C{=}CHR_1$ wherein $R_1$ is a straight or branched chain alkyl radical comprising 1 to 18 carbon atoms and preferably 1 to 10 carbon atoms. When $R_1$ is a branched chain, the branch is preferred to be at least two carbons away from the double bond.

The copolymers are prepared by copolymerizing a feed containing ethylene and one or more alpha olefins in the weight ratio of 60:40 to about 5:95 in the presence of a metallocene catalyst system.

Metallocene catalyst systems are well known in the art and mention is made of U.S. Pat. No. 5,859,159, incorporated herein by reference, for a description of metallocene catalysts systems useful for producing the polymers from ethylene and one or more alpha-olefins suitable for the lubricant fluid blends of the present invention.

The polymer is produced by polymerizing a reaction mixture of ethylene and at least one additional alpha-olefin monomer in the presence of a metallocene catalyst system, preferably in solution. Optionally, hydrogen may be added to regulate the degree of polymerization or molecular weight, and to reduce the amount of unsaturation in the product. In such situations the amount of hydrogen typically will be 0.1 mole % to 50 mole % based on the amount of ethylene.

Any known solvent effective for such polymerization can be used. For example, suitable solvents include hydrocarbon solvent such as aliphatic, cycloaliphatic and aromatic hydrocarbons. The preferred solvents are propane, isobutane, pentane, isopentane, hexane, isohexane, heptane, isoheptane, Norpar, Isopar, benzene, toluene, xylene, alkylaromatic-containing solvents, or mixture of these solvents.

The polymerization reaction may be carried out in a continuous manner, such as in a continuous flow stirred tank reactor where feed is continuously introduced into the reactors and product removed therefrom. Alternatively, the polymerization may be conducted in a batch reactor, preferably equipped with adequate agitation, to which the catalyst, solvent, and monomers are added to the reaction and left to polymerize therein for a time sufficient to produce the desired product.

Typical polymerization temperature for producing the copolymers useful herein are in the range of about 0° C. to about 300° C. and preferably 25° C. to 250° C. at pressures of about 15 to 1500 psig, and preferably 50 to 1000 psig.

The conditions under which the polymerization is conducted will determine the degree of unsaturation in the resulting copolymer. As is known in the art, the degree of unsaturation of a polymer can be measured by bromine number. In the present invention it is preferred that the copolymer have a bromine number below 2 and more preferably in the range of 0 to 1.

In those instances where the product copolymer has a high degree of unsaturation, such as when the copolymer product has a viscosity less than about 1000 cSt at 100° C., the copolymer preferably is hydrogenated to provide a final product having a bromine number below 2. The hydrogenation may be carried out in a batch mode or in continuous stir tank or in a continuous fixed bed operation, using typical hydrogenation catalysts. Examples of the hydrogenation catalysts are nickel on kieselguhr catalyst, Raney Nickel catalyst, many commercial hydro-treating catalyst, such as nickel, cobalt, molybdenum or tungsten on silica, silica-alumina, alumina, zirconium support, etc., or supported Group VIIIB metals, such as platinum, palladium, ruthenium and rhodium. The hydrogenation conditions may range from room temperature to 300° C. with hydrogen pressure from atmospheric pressure to 2000 psi for long enough residence time to reduce most or all of the unsaturation. The unsaturation degree can be measured by bromine number of iodine index. Preferably the bromine number of the finished product should be below 2. The lower the bromine number the better the oxidative stability. More preferably, the reaction temperature, pressure, residence time, catalyst loading all will be adjusted to achieve 0-1bromine number.

In instances where the polymerization conditions favor the formation of copolymers having a very low degree of unsaturation, hydrogenation of the copolymer is not necessary and the copolymer can be used directly in forming the lubricant blend.

The other major component, component B, in the fluid blend of the present invention is a polyalpha olefin or a hydroprocessed oil having a VI greater than 80. Examples of such oils are Group II and III oils, Fischer-Tropsch wax isomerates (as disclosed in U.S. Pat. No. 6,090,989, U.S. Pat. No. 6,080,301 or U.S. Pat. No. 6,008,164) and Group IV synthetic polyalpha olefin fluids.

The amounts of ethylene α-olefin copolymer and hydroprocessed oils in the blends of fluid the present invention are not critical and will depend on the intended use of the blend. In general the amount of ethylene α-olefin copolymer will constitute from about 1 to about 95 wt % of the blend. Generally, it is preferred to be from about 5 to 80 wt %, more preferably from about 40 to 60 wt %. If too small amount of the polymer is used, the blend will not have sufficient viscometrics. On the other hand, if too much of the polymer is used, it maybe more costly or the blend viscosity may be too high for practical use.

The fluid blends of the present invention can be combined with selected lubricant additives to provide lubricant compositions.

The additives listed below are typically used in such amounts so as to provide their normal attendant functions. Typical amounts for individual components are also set forth below.

| | Broad Wt % | Preferred Wt % |
|---|---|---|
| Viscosity Index Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergents and Rust Inhibitors | 0.01-6 | 0.01-3 |
| Pour Point Depressant | 0.01-1.5 | 0.01-1.5 |
| Antifoaming Agents | 0.01-0.1 | 0.001-0.01 |
| Antiwear Agents | 0.001-5 | 0.001-2 |
| Extreme Pressure Additives | 0.001-5 | 0.001-2 |
| Seal Swellant | 0.1-8 | 0.1-4 |
| Friction Modifiers | 0.01-3 | 0.01-1.5 |
| Fluid Blend of Invention | ≧80% | ≧80% |

When other additives are employed, it may be desirable, although not necessary, to prepare additive concentrates comprising concentrated solutions or dispersions of the dispersant, together with one or more of the other additives to form an additive mixture, referred to herein as an additive package whereby several additives can be added simultaneously to the base stock to form the lubricating oil composition. Dissolution of the additive concentrate into the lubricating oil may be facilitated by solvents and by mixing accompanied with mild heating, but this is not essential. The concentrate or additive-package will typically be formulated to contain the dispersant additive and optional additional additives in proper amounts to provide the desired concentration in the final formulation when the additive package is combined with a predetermined amount of the fluid blend of the invention.

All of the weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

The composition of the invention may also include a co-base stock to enhance lubricant performance or to improve additive solubility in the basestock. Typically co-basestocks are selected from polar fluids useful as lubricants.

Examples of these fluids include many types of esters, alkylaromatics, and oil-soluble polyalkylene glycols. Typical esters used in lubricant formulations include polyol esters, adipate esters, sibacate esters, phthalate esters, sterates, etc. Typical alkylaromatics used in lube formulation include alkylated naphthalenes, alkylbenzenes, alkyltoluenes, detergent alkylate bottoms, etc. Typical oil-soluble polyalkylene glycols include poly-propylene oxides, poly-butylene oxides, etc. Such fluids may be used in amounts of about 1 wt % to about 60 wt % although amounts of about 1 wt % to about 10 wt % are preferred.

The present invention is further illustrated by the examples which follow.

EXAMPLES

Example 1

1-butene was charged at 100 ml/hour and ethylene was charged at 16 gram/hour to a 600 ml autoclave containing a catalyst solution of 20 mg zirconocene dichloride, 0.4 gram methylaluminoxane and 50 gram toluene, and cooled in an ice water bath. The feeds were discontinued after four hours. After 12 hours of reaction at room temperature or below, the reaction was quenched with water and alumina. The catalyst and any solid was removed by filtration.

The viscous liquid product was isolated in 90% yield by distillation at 140° C./0.1 millitorr for 2 hours to remove any light end. This liquid product was further hydrogenated at 200° C., 1000 psi $H_2$ pressure using 2 wt % nickel on Kieselguhr catalyst for 4 hours. The hydrogenated copolymer product had the following properties: 100° C. Kv=45.8 cSt, 40° C. Kv=548.0 cSt, VI=136, pour point =−36° C. This polymer contains 28.6 wt % ethylene as measured by C13-NMR.

Example 2

Similar to Example 1, except ethylene was added at 20 grams per 25 hour. The distilled liquid yield=92%. The hydrogenated product had the following properties: 100° C. Kv=161.3 cSt, 40° C. Kv=2072.8 cSt, VI=190, pour point=−25° C. This polymer contains 38.7 wt % ethylene as measured by C13-NMR. The Mn of this polymer is 2280 and MWD is 2.66.

Example 3

This polymer was prepared in a continuous mode of operation. In this reaction, polymer grade ethylene, polymer grade 1-butene and polymer grade iso-butane solvent were charged into a 200 gallon reactor after purification through molecular sieve and treatment by injecting 50 ppm tri-t-butylaluminum. The feed rates for ethylene, 1-butene and iso-butane were 12, 120 and 180 lb/hour, respectively. A catalyst solution, containing $5\times10^{-6}$ g-mole/liter of dimethylsilylbis (4,5,6,7 tetrahydro-indenyl) zirconium dichloride and methylaluminoxane of 1/400 Zr/Al molar ratio in toluene, was charged into the reactor at 13.5 ml/minute. The reactor temperature was maintained 89.4° C. and 95.6° C., pressure 237-261 psi and average residence time 2 hours. The crude reaction product was withdrawn form the reactor continuously and washed with 0.4 wt % sodium hydroxide solution followed with a water wash. A viscous liquid product was obtained by devolitalization to remove iso-butane solvent, light stripping at 66° C./5 psig followed by deep stripping at 140° C./I millitorr. The residual viscous liquid was then hydro-finished at 200° C., 800-1200 psi $H_2$ pressure with 2 wt % Ni-on-Kieselguhr catalyst for eight hours. The hydrogenated product contains 34 wt % ethylene content and had the following properties: 100° C. Kv=114.0 cSt, 40° C. Kv=1946.5 cSt, VI=145 and pour point=−24° C. This polymer has Mn of 2374 and MWD of 1.88.

Example 4

This polymer was prepared in a similar manner as in Example 3, except that the feed rates for ethylene, 1-butene and isobutane were 58, 120 and 283 lb/hour, and the reaction temperature was between 98.3° C. and 101.1° C., pressure 290-300 psi and average residence time 1 hour. After hydrofinishing, the lube base stock contained 44 wt % ethylene and had the following properties: 100° C. Kv=149.9 cSt, 40° C. Kv=2418.4 cSt, VI=164 and pour point=−24° C. This polymer has Mn of 2660 and MWD of 1.76.

Example 5

This polymer was prepared in a similar manner as in Example 3, except that the feed contained 40 wt % 1-butene, 11 wt % ethylene and 49 wt % isobutane, the reaction temperature was 71° C., and average residence time 1 hour. After hydrofinishing, the hydrogenated product contained 19 wt % ethylene and had the following properties: 100° C. Kv=1894 cSt, 40° C. Kv=42608 cSt, VI=278 and pour point=−1° C. This polymer has Mn of 5491 and MWD of 2.80.

Example 6

This polymer was prepared in a similar manner as in Example 3, except that the feed contained 40 wt % 1-butene, 35 wt % ethylene and 25 wt % isobutane, the reaction temperature was 93.3° C., and average residence time approximately 1 hour. After hydrofinishing, the lube base stock contained 44.5 wt % ethylene and had the following properties: 100° C. Kv=1493 cSt, 40° C. Kv=49073 cSt, VI=230 and pour point=5° C. This polymer has Mn of 5664 and MWD of 2.76.

Example 7

1-butene was charged at 100 ml/hour, ethylene was charged at 30 gram/hour and hydrogen gas was charged at 21.8 ml per minute into a 600 ml autoclave containing a catalyst solution of 20 mg zirconocene dichloride, 4.0 gram of 10 wt % methylaluminoxane in toluene and 50 gram toluene, and cooled in an ice water bath. The reaction mixture quickly warmed to 25° C. The reaction temperature was maintained at close to room temperature with water/ice cooling. The feeds were discontinued after four hours. After 12 hours of reaction at room temperature or below, the reaction was stopped by addition of air to the reactions system. The viscous liquid product was isolated in 73% yield by distillation at 140° C./0.1 millitorr for 2 hours to remove any light end. The isolated ethylene-butene copolymer product had the following properties: 100° C. Kv=28.0 cSt, 40° C. Kv=234.2 cSt, VI=156. This polymer contains about 33 wt % ethylene.

Example 8

A series of blends were prepared using copolymers of the invention and a hydroprocessed Group III or a Group II base stock. For comparative purposes additional blends of the Group III and Group II basestocks were prepared using the blending fluids shown in Table 1.

TABLE 1

| Blending Fluid | 100° C. Kv, cSt | 40° C. Kv, cSt | VI | Pour Point, ° C. |
|---|---|---|---|---|
| PIB H50① | 117 | 3442 | 104 | −15 |
| PIB H300① | 663 | 25099 | 117 | 2 |
| Bright Stock | 32 | 474 | 96 | −7 |
| 100 cSt PAO② | 100 | 1250 | 170 | −23 |
| Bright Stock A | 31 | 455 | 97 | −9 |

①PIB H5O and H300 are trade names for polyisobutylene sold by BP Chemical Co. BP Nort America (chemicals), 150 W Warrenville Rd., N-3, Naperville, IL 60563 USA.
②The 100 cST PAO is available from ExxonMobile Chemical Co at Edison, NJ.

The properties of the blends made from the Group III basestocks with the copolymers of Example 3, PIB HSO and bright stock were determined and are shown in Table 2.

TABLE 2

| Blend Number | Blending Stock Fluid | Wt % Blending Fluid in Group III | 100° C. Kv, cSt | 40° C. Kv, cSt | VI | Thickening Efficiency |
|---|---|---|---|---|---|---|
| Group III | — | 0.0 | 3.98 | 16.70 | 140 | — |
| 1 | Example 3 | 9.1 | 5.51 | 25.28 | 164 | 94 |

TABLE 2-continued

| Blend Number | Blending Stock Fluid | Wt % Blending Fluid in Group III | 100° C. Kv, cSt | 40° C. Kv, cSt | VI | Thickening Efficiency |
|---|---|---|---|---|---|---|
| 2 | Example 3 | 25.0 | 9.41 | 51.78 | 167 | 140 |
| 3 | Example 3 | 50.0 | 20.92 | 155.74 | 158 | 278 |
| 4 | PIB H50 | 9.1 | 4.80 | 21.80 | 148 | 56 |
| 5 | PIB H50 | 25.0 | 6.73 | 36.63 | 143 | 80 |
| 6 | PIB H50 | 50.0 | 13.06 | 105.03 | 120 | 177 |
| 7 | Bright Stock | 9.1 | 4.50 | 20.49 | 136 | 42 |
| 8 | Bright Stock | 25.0 | 5.79 | 30.18 | 138 | 54 |
| 9 | Bright Stock | 50.0 | 9.28 | 62.29 | 128 | 91 |

Figure 2:
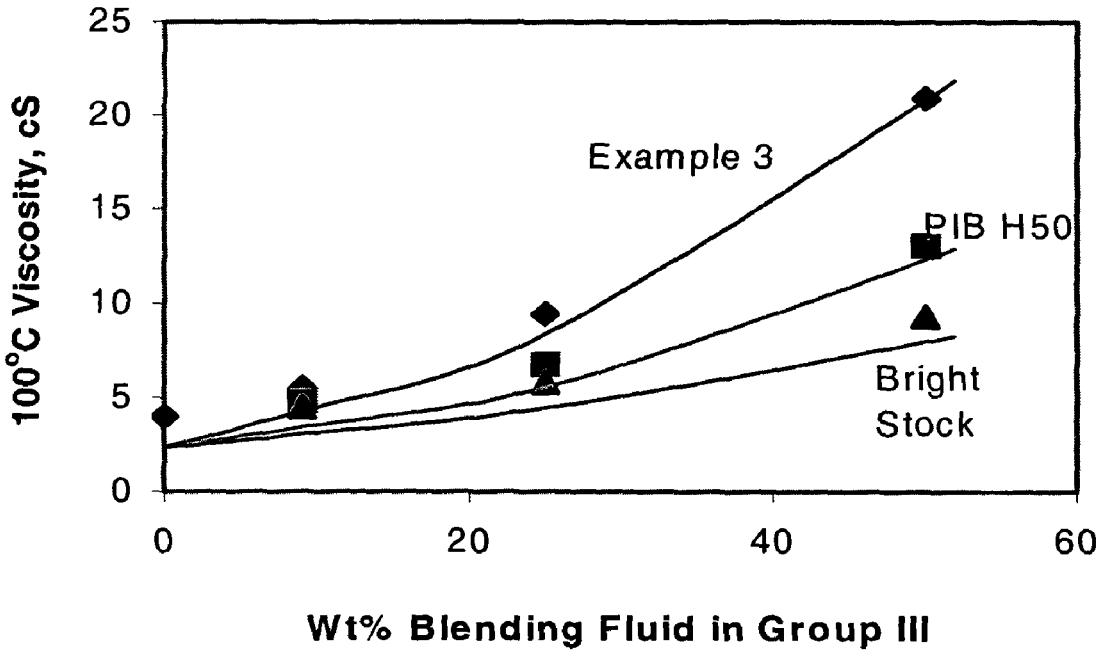
Figure 3:
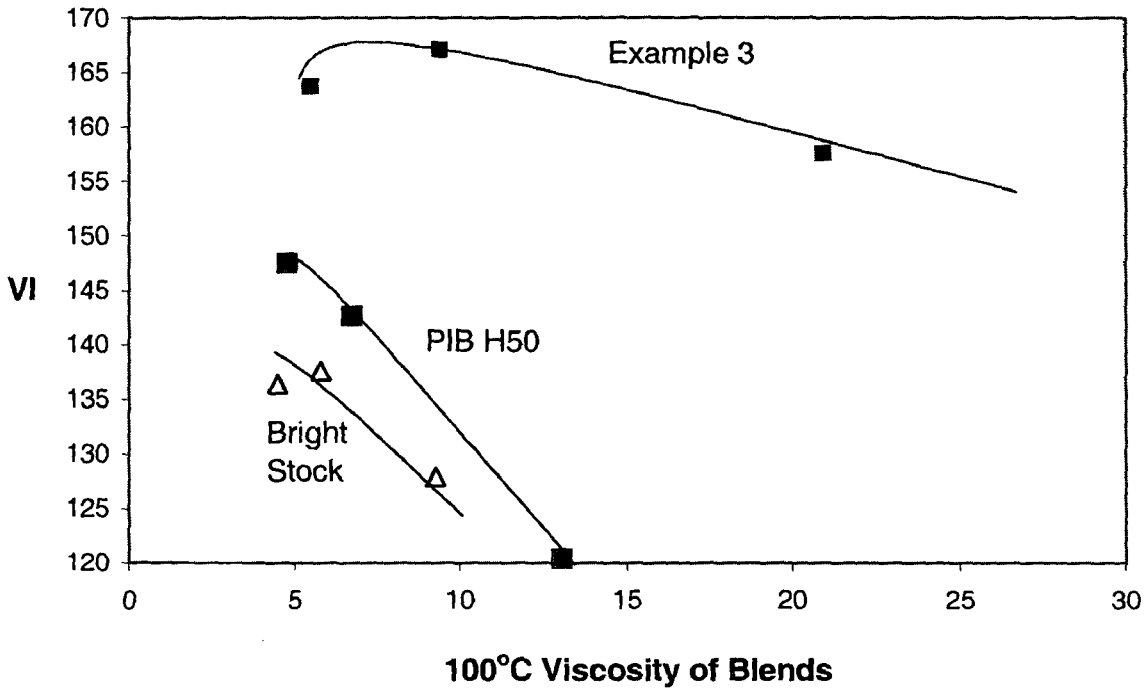

Although the Example 3 polymer and PIB H50 both have the similar 100° C. viscosities, the blends from Example 3 have higher 100° C. and 40° C. viscosities than PIB at same weight percent (FIGS. 1 and 2). The thickening efficiency for Example 3 is also higher than PIB. These data demonstrated that the Example 3 sample have better viscosity boosting effect than PIB of comparable viscosity. Furthermore, the lube base fluids made from Example 3 and Group III base stocks have higher VI at similar 100° C. viscosity, as shown in FIG. 3. Similar trends were observed when compared to the blends with bright stock.

The properties of blends made from the Group III base stock with the copolymer of Example 2, Example 4 and PIB H300 were determined and are shown in Table 3.

TABLE 3

| Blend Number | Blending Stock Fluid | Wt % Blending Fluid in Group III | 100° C. Kv, cSt | 40° C. Kv, cSt | VI | Thickening Efficiency |
|---|---|---|---|---|---|---|
| Group III | — | 0.0 | 3.98 | 16.70 | 140 | — |
| 10 | Example 2 | 9.1 | 6.01 | 27.82 | 171 | 122 |
| 11 | Example 2 | 25.0 | 11.58 | 63.62 | 179 | 188 |
| 12 | Example 2 | 50.0 | 29.27 | 203.81 | 184 | 374 |
| 13 | Example 4 | 9.1 | 5.74 | 26.51 | 167 | 108 |
| 14 | Example 4 | 25.0 | 10.36 | 56.49 | 175 | 159 |
| 15 | Example 4 | 50.0 | 24.21 | 165.04 | 179 | 297 |
| 16 | PIB H50 | 9.1 | 5.34 | 24.99 | 155 | 91 |
| 17 | PIB H50 | 25.0 | 9.50 | 55.80 | 154 | 156 |
| 18 | PIB H50 | 50.0 | 26.39 | 258.11 | 133 | 483 |

Figure 4:
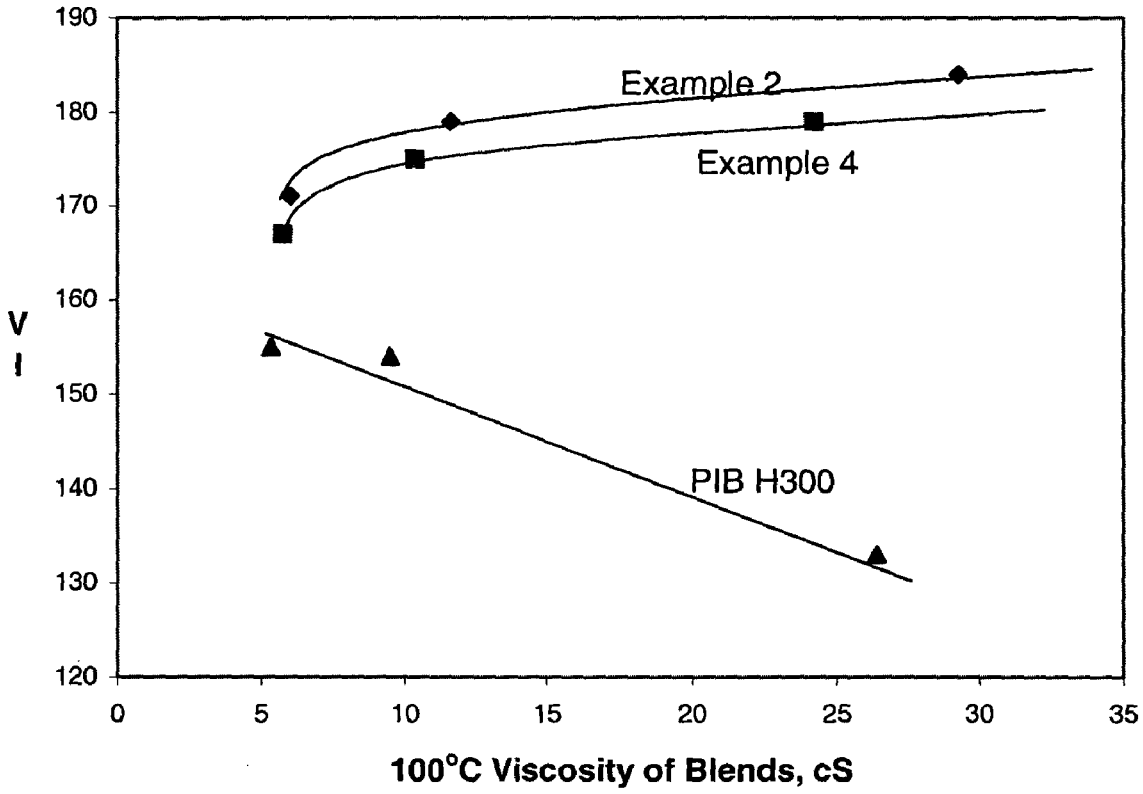

Although Examples 2 and 4 fluids both have much lower 100° C. viscosities than PIB H300 (161 cSt and 150 cSt vs. 663 cSt), the blends from Example 2 and 4 fluids have higher viscosities than those from PIB H300. At the same weight percent of blend stock, the thickening efficiencies of Example 2 and 4 fluids are higher than PIB H300. These data demonstrate that Example 2 and 4 fluids have better viscosity-boosting effect than PIB. Also, the VI of the blends from Example 3 and 5 fluids are higher than those from PIB H300 (FIG. 4).

The properties of blends prepared form the Group III base stock with the Example 5 and 6 fluids were determined and are shown in Table 4.

TABLE 4

| Blend Number | Blending Stock Fluid | Wt % Blending Fluid in Group III | 100° C. Kv, cSt | 40° C. Kv, cSt | VI | Thickening Efficiency |
|---|---|---|---|---|---|---|
| Group III | — | — | 3.98 | 16.70 | 140 | — |
| 19 | Example 5 | 2.0 | 4.71 | 20.45 | 157 | 204 |
| 20 | Example 5 | 5.0 | 6.15 | 28.20 | 176 | 237 |
| 21 | Example 5 | 1.0 | 9.42 | 46.38 | 192 | 300 |
| 22 | Example 6 | 2.0 | 4.61 | 19.84 | 156 | 174 |
| 23 | Example 6 | 5.0 | 5.75 | 26.15 | 171 | 196 |
| 24 | Example 6 | 1.0 | 8.27 | 40.81 | 183 | 244 |

As can be seen the blends have a VI that is higher than the Group III base stock alone.

Blends were prepared from a Group II basestock with the Example 3 and 4 fluids and with PIB H50. The details and properties of the blends are given in Table 5.

TABLE 5

| Blend Number | Blending Fluid | Wt % | 100° C. Kv, cSt | 40° C. Kv, cSt | VI |
|---|---|---|---|---|---|
| 25 | PIB H50 | 9.1 | 10.62 | 90.96 | 99 |
| 26 | PIB H50 | 25.0 | 14.65 | 147.06 | 98 |
| 27 | PIB H50 | 50.0 | 24.93 | 342.48 | 94 |
| 28 | Example 3 | 9.1 | 12.01 | 101.03 | 109 |
| 29 | Example 3 | 25.0 | 18.93 | 179.30 | 119 |
| 30 | Example 3 | 50.0 | 36.01 | 415.09 | 129 |
| 31 | Example 4 | 9.1 | 12.51 | 97.88 | 122 |
| 32 | Example 4 | 25.0 | 20.41 | 188.71 | 126 |
| 33 | Example 4 | 50.0 | 40.25 | 413.78 | 147 |

As can be seen, the blends from Example 2 and 3 fluids had higher viscosities and VIs then blends with PIB.

Example 9

A series of blends of ISO 32 viscosity grade were prepared from the Group III base stock, Example 3 and 4 fluids, PIB PAO and bright stock. The blend viscosities, thickening efficiency and shear stability (ASTM Test D 5621) were determined and are shown in Table 6.

TABLE 6

| Blend Number | Blending Fluid | Wt % | 100° C. Kv, cSt | 40° C. Kv, cSt | VI | Shear Viscosity | % Shear Loss | Thickening Efficiency |
|---|---|---|---|---|---|---|---|---|
| 34 | Example 3 | 14.4 | 6.465 | 31.67 | 163 | 31.66 | 0.0% | 105 |
| 35 | Example 4 | 13.5 | 6.839 | 32.83 | 174 | 32.78 | 0.2% | 121 |
| 36 | Example 3 | 33 | 9.41 | 51.78 | 167 | 51.60 | 0.3% | 107 |
| 37 | PIB H300 | 13.1 | 6.104 | 29.77 | 159 | 29.22 | 1.8% | 101 |
| 38 | Example 2 | 9 | 6.01 | 27.82 | 171 | 27.45 | 1.3 | 125 |

TABLE 7

Shear Stability Comparison of Example 5 and 6 Polymers with Comparative Blends

| Blend No. | Blending Fluid | Wt % | 100° C. Kv, cSt | 40° C. Kv, cSt | Shear Viscosity | % Shear Loss | Thickening Efficiency |
|---|---|---|---|---|---|---|---|
| 39 | Example 5 | 6.8 | 6.68 | 30.91 | 30.42 | 1.6 | 211 |
| 40 | Example 6 | 6.3 | 6.99 | 32.22 | 31.81 | 1.3 | 249 |
| 41 | Viscoplex 8-219 (b) | 6 | 6.36 | 32.68 | 30.69 | 6.1 | 167 |

As can be seen, the blending fluids of this invention (Blends 34 to 36) have comparable thickening efficiency as the best comparative example (Blend 38). At this comparable thickening efficiency, the copolymer blend of the invention (Blend 34 to 36) has better shear stability than that of the PIB blend 37.

Similarly, a blend (blend no 38) is prepared using the Example 2 fluid, which has a much broader MWD (2.66) than the Example 3 and 4 polymers. The polymer again has excellent thickening efficiency (Table 6), better than PIB H300. However, this polymer still has better shear stability than PIB when tested in the D5621 method.

Data in Table 6 further demonstrated that the blends containing polymers from ethylene-alpha-olefins with narrower molecular weight distribution have better shear stability. Blends 34 to 36 were prepared using polymers with MWD of 1.75 to 2.01. They have slightly better shear stability (0.2% viscosity loss) than the blend prepared by using polymer with MWD of 2.66 (blend 38 with 1.3% viscosity loss). Therefore, we conclude that blends containing polymer made from ethylene and alpha-olefins with narrower MWD are more desirable than blends made from ethylene and alpha-olefins with broader MWD.

Table 7 compares the shear stability of the blends made with Example 5 and Example 6 (blend 39 and 40) versus a blend made with commercial sample, Viscoplex 8-219 (available from RohMax USA, Inc) of comparable thickening efficiency in a Group III base stock. As the data showed that blends 39 and 40 have much better shear stability with only 1.3 and 1.6% viscosity loss as compared to the comparative blend 41 with 6% viscosity loss.

Example 10

In another set of experiments, ethylene alpha-olefins copolymers were prepared similar to Example 3 except using different amounts of ethylene in the feed. The polymers when blended with Group III base stocks are clear and bright and have excellent viscometrics as shown in Table 8. These example demonstrated that even with high ethylene content (44 wt %) and MWD of 2.3, blends of excellent properties can be obtained.

TABLE 8

Blend Properties of Group III base stocks with ethylene alpha-olefins of high ethylene contents

| Wt % $C_2H_4$ in blend stock | Mn by GPC | MWD | Wt % in Group III base stock | 100° C. vis, cSt | 40° C. vis, cSt | VI | Appearance |
|---|---|---|---|---|---|---|---|
| 40.6 | 6667 | 2.23 | 5 | 7.59 | 36.35 | 184 | clear |
| 44.0 | 5050 | 2.3 | 5 | 6.59 | 32.73 | 181 | clear |

Example 11

Lubricants with kV @ 40° C. of about 220 cSt were prepared by blending a combination of EBC (Examples 3 and 7) and Group II base stock, for comparison against "Bright Stock A" and a mixture of Group II and Group I stocks thickened with 20% PIB. All blends were further additized with the same additives to the same treat level.

The oxidative stability of the EBC-Group II blend is far superior to that of the conventional Group 1 mineral oil as shown by RBOT data and both the oxidative and thermal stability of the EBC-Group II blend is superior to that of the PIB thickened Group I/Group II blend shown by the RBOT data and by its resistance to loss of both viscosity and weight. Use of Group II hydroprocessed base stock and PIB to displace some of the conventional Group 1 mineral oil in the all conventional Group 1 mineral oil formulation improved the oxidative stability and pour point, but the thermal stability and resistance to loses of viscosity and weight were not as good as with the Group II-EBC combination.

Thus, it is seen that viscosity loss and weight loss can be reduced and the oxidation stability and low temperature properties can be improved for lubricating oil formulations comprising a base stock comprising a Group II base oil, a Group III base oil or mixture thereof, preferably a Group II base oil by combining with such base oil one or more copolymers of ethylene with one or more alpha olefins said copolymer(s) containing not more than 50 wt % ethylene, the copolymer(s) having a number average molecular weight from 400 to 10,000 and having a molecular weight distribution <3.

TABLE 9

| Wt % | Group II/EBC | Group I | Group II/ Group I/PIB |
|---|---|---|---|
| EBC 114 cSt (Example 3) | 35.9 | | |
| EBC 28 cSt (Example 7) | 9.0 | | |
| PAO 100 cSt | | | |
| Hydroprocessed base stock (Group II) | 31.8 | | 33.1 |
| Bright stock A | | 76.7 | 23.5 |
| PIB | | | 20.0 |
| Additives | 23.3 | 23.3 | 23.3 |
| KV @ 40° C. (cSt) | 241 | 211 | 246 |
| D2272 (RBOT), minute | 1906, 2147 | 750, 760 | 1055, 1153 |
| Pour point, ° C. | −28 | −22 | −24 |
| After thermal stability test, 1 day at 300° C. | | | |
| % loss in KV at 40° C. | 5.2 | −4.2 | 26.0 |
| % weight loss | 0.0 | 0.0 | 1.6 |

Comparative Example

Following the procedure of Example 3, except using higher ethylene feed rate, a copolymer sample containing 50.8 wt % ethylene was prepared. This polymer has Mn of 2386, which is comparable to example 3. However, it has broader MWD of 2.81, instead of 1.88 as the Example 3 polymer.

This polymer with high ethylene content and broad MWD was found to be not as good as that of Examples 1 to 7. When blended with same Group III base stock used in the blend of the examples, the resulting blend was very cloudy and the blend would not be used as high performance base stock. Furthermore, when 20% of this comparative polymer was blended with Group III base stock, the blend had only 124 VI, whereas a similar blend with Example 3 polymer has VI of 167 or 158, as shown in Table 8.

TABLE 10

Comparison of blend properties

| Blend Number | Blending Stock Fluid | Wt % Blending Fluid in Group III | 100° C. Kv, cSt | 40° C. Kv, cSt | VI |
|---|---|---|---|---|---|
| Group III | — | 0.0 | 3.98 | 16.70 | 140 |
| 2 | Example 3 | 25.0 | 9.41 | 51.78 | 167 |
| 3 | Example 3 | 50.0 | 20.92 | 155.74 | 158 |
| Comparative blend | Comparative polymer | 20 | 18.07 | 150.14 | 124 |

What is claimed is:

1. A lubricating oil base stock consisting of:

(a) a copolymer of ethylene with one or more alpha olefins, containing not more than 50 wt % ethylene, the copolymer having a number molecular weight from 400 to 10,000 and having a molecular weight distribution <3; and (b) a hydroprocessed oil having a VI greater than 80, characterized in that the base stock has a VI which is higher than that of the hydroprocessed oil component alone.

2. The base stock of claim 1 wherein the alpha olefin of the copolymer is a $C_3$ to $C_{20}$ olefin.

3. The base stock of claim 2 wherein the hydroprocessed oil is selected from Group II and Group III oils and Fischer-Tropsch wax isomerates.

4. The base stock of claim 3 wherein the amount of copolymer in the blend ranges from about 1 to about 95 wt %.

5. The base stock of claim 4 wherein the hydroprocessed oil is a Group III oil.

6. The base stock of claim 4 wherein the hydroprocessed oil is a Group II oil.

7. A lubricant base stock consisting of a blend of (a) from 1 to 95 wt %, based on the blend, of an ethylene alpha olefin copolymer of ethylene with one or more alpha olefins containing not more than 50 wt % ethylene, the copolymer having a number average molecular weight from 400 to 10,000 and having a molecular weight distribution <3; and (b) from 5 to 99 wt %, based on the blend, a hydroprocessed oil having a VI greater than 80 and selected from Group II and Group III oils and Fischer-Tropsch wax isomerates characterized in that the base stock blend has a VI which is higher than that of the hydroprocessed oil component alone.

8. The base stock of claim 7 wherein the alpha olefin of the copolymer is a $C_3$ to $C_{20}$ olefin.

9. The base stock of claim 8 wherein the hydroprocessed oil is a Group II oil.

10. The base stock of claim 8 wherein the hydroprocessed oil is a Group III oil.

11. A lubricant which is prepared from:

(i) a lubricant base stock consisting of a blend of:

(a) a copolymer of ethylene with one or more alpha olefins containing not more than 50 wt % ethylene, the copolymer having a number average molecular weight from 400 to 10,000 and a molecular weight distribution <3; and (b) a hydroprocessed oil having a VI greater than 80 wherein the base stock blend has a VI which is higher than that of the hydroprocessed oil component alone; and (ii) a lubricant additive package.

12. The lubricant of claim 11 wherein the alpha olefin of the copolymer is a $C_3$ to $C_{20}$ olefin.

13. The lubricant of claim 12 wherein the hydroprocessed oil is a Group II oil.

14. The lubricant of claim 12 wherein the hydroprocessed oil is a Group III oil.

15. The lubricant of claim 13 or 14 in which the additive package comprises additives selected from the group consisting of viscosity index improvers, corrosion inhibitors, dispersants, oxidation inhibitors, detergents, rust inhibitors, antiwear agents, anti-foaming agents, flow improvers, friction modifiers, and seal swellants.

16. A lubricant which is prepared from:

(i) a lubricant base stock consisting of a blend of:

(a)copolymer of ethylene with one or more alphagolefins containing not more than 50 wt % ethylene, the copolymer having a number average molecular weight from 400 to 10,000 and a molecular weight distribution <3; and (b) a hydroprocessed oil having a VT greater than 80 wherein the base stock blend has a VI which is higher than that of the hydroprocessed oil component alone;

(ii) a lubricant additive package; and (iii) a polar co-base stock selected from the group consisting of polyesters, alkylated aromatics and polyalkylene glycols.

17. A method for reducing the loss of viscosity and weight and improving the oxidation stability and low temperature properties of lubricating oil formulations comprising a base oil by employing a base stock consisting of hydroprocessed oil selected from the group consisting of a Group II base oil, a Group III base oil or mixture thereof in combination with a copolymer of ethylene with one or more alpha-olefins containing not more than 50 wt % ethylene, the copolymer having a number average molecular weight from 400 to 10,000 and having a molecular weight distribution <3, wherein the base stock has a VI which is higher than that of the hydroprocessed oil component alone.

* * * * *